US005690331A

United States Patent [19]

Sides

[11] Patent Number: 5,690,331

[45] Date of Patent: Nov. 25, 1997

[54] FOUR-FACED DIE

[75] Inventor: William A. Sides, North Charleston, S.C.

[73] Assignee: TSR, Inc., Lake Geneva, Wis.

[21] Appl. No.: 698,033

[22] Filed: Aug. 7, 1996

[51] Int. Cl.[6] ..... A63F 9/04

[52] U.S. Cl. ..... 273/146; D21/41

[58] Field of Search ..... 273/146, 288–291; D21/41, 51

[56] References Cited

U.S. PATENT DOCUMENTS

| | | | |
|---|---|---|---|
| 1,203,472 | 10/1916 | Branch | 273/146 |
| 1,795,562 | 3/1931 | King et al. | 273/146 |
| 3,208,754 | 9/1965 | Sieve | 273/146 |
| 3,650,534 | 3/1972 | Collett | 273/288 |
| 4,345,761 | 8/1982 | China | 273/146 |
| 4,346,900 | 8/1982 | Lamlee | 273/274 |
| 4,632,397 | 12/1986 | Rivkin | 273/145 CA |
| 5,004,244 | 4/1991 | Johnson | 273/146 |
| 5,375,845 | 12/1994 | Cooter et al. | 273/146 |

OTHER PUBLICATIONS

Dragon Magazine, Issue No. 183, Jul. 1992, p. 13, published by TSR Inc., Lake Geneva, WI.

Allen Varney, "The Current Clack", Dragon Magazine, Issue No. 234, Oct. 1996, p. 120, published by TSR Inc., Lake Geneva, WI.

*Primary Examiner*—Benjamin H. Layno

*Attorney, Agent, or Firm*—Jenner & Block

[57] ABSTRACT

A die has four faces in the shape of isosceles triangles. The die uses an efficient amount of material and can be read without the player having to pick up the die. Each face of the die has placed thereon an indicium corresponding to only a single face. The die provides an equal chance for each of the four faces to be selected.

12 Claims, 1 Drawing Sheet

FOUR-FACED DIE

BACKGROUND OF THE INVENTION

1. Field of the Invention

The present invention relates to dice generally, and more particularly, to a four-faced die having a novel configuration and properties.

2. Description of the Related Art

Dice having four possible outcomes are known in the art. For example, U.S. Pat. No. 1,795,5622 to King et al. discloses a playing die that has four possible outcomes. The configuration of this die includes excess material beyond that which is needed to form the four faces that display the relevant indicia. As such, it would be desirable to provide a four-faced die that does not require this excess material.

U.S. Pat. Nos. 3,208,754 to Sieve, 4,345,761 to China and 4,632,397 to Rivkin disclose tetrahedron-shaped four-faced dice. However, the selected face of each of these dice is in contact with the flat surface on which they are rolled. Thus, the selected face is not visible to the player. As such, an individual must pick up the die or otherwise determine which face has been selected. Therefore, it would be desirable to provide a four-faced die wherein the selected face is visible.

One attempt to solve this problem with the tetrahedron die is shown in FIG. 1 herein. FIG. 1 shows a prior art four-faced tetrahedron-shaped die 10. Die 10 has faces 12, 14, 16 and 18. In order to eliminate the requirement that the user pick up die 10, the indicium that corresponds to the selected face is placed on each of the remaining three faces near the apex of die 10 that is opposite to the selected face. For example, in FIG. 1, face 12 has indicia 12', 12" and 12'" placed thereon and face 14 has indicia 14', 14" and 14'" placed thereon. Indicia 12' and 14' correspond to face 16 being selected. In this way, the player does not have to pick up die 10 or otherwise deduce that face 16 is the selected face. Instead, the player looks at the indicia printed on the apex of die 10 that is opposite the selected face. However, die 10 requires printing three different indicia on each face. This can increase manufacturing costs and, in many applications, can be impractical. This is especially true where relatively complicated indicia, e.g., pictures, are to be used. The complexity of the indicia is limited by the fact that they must be printed small enough to fit three separate indicia on each face of the die. In addition, the smaller indicia are harder to read. Thus, it would be desirable to provide a four-faced die wherein only the indicium corresponding to a single selected face is required to be placed on each face of the die.

Finally, U.S. Pat. No. 4,346,900 to Lamlee discloses a four-faced die. However, the die does not provide four identically shaped faces and does not provide an equal chance for each of the four faces to be selected. A four-faced die having an equal chance for each of the four faces to be selected is desirable in many applications.

Therefore, it would be desirable to provide a four-faced die that uses an efficient amount of material, can be read without being picked up by the player, does not require indicia corresponding to more than one selected face to be placed on each face and provides an equal chance for each of the four faces to be selected.

SUMMARY OF THE INVENTION

A four-faced die in accordance with the present invention accomplishes each of these goals. The four-faced die can be rolled on a flat surface to determine a selected face. The die includes four faces each having edges that form an isosceles triangle. Each face has a first edge and a second edge of equal length and a third edge having a different length. Each of the equal length edges of each face forms one of the equal length edges of an adjacent face. Each third edge of each face forms the third edge of an adjacent face. Each face has an indicium thereon. When one of the faces of the die is at rest on the flat surface, another one of the faces extends upwardly from the surface and has its third edge parallel to the flat surface. This upwardly extending face is the selected face.

The length of the first edge can be greater than the length of the third edge. The length of the first edge and the length of the third edge of one of the faces can form a ratio of about 5:3. The angles defined by the edges of each face can be about 72.5°, 72.5° and 35° The die can be made of plastic. The surface areas of each of the isosceles triangles of each face can be equal. Each of the faces can have an equal chance of being the selected face. The die can achieve either a uniform probability distribution or a nonuniform probability distribution.

DETAILED DESCRIPTION THE PREFERRED EMBODIMENT

Figure 1:
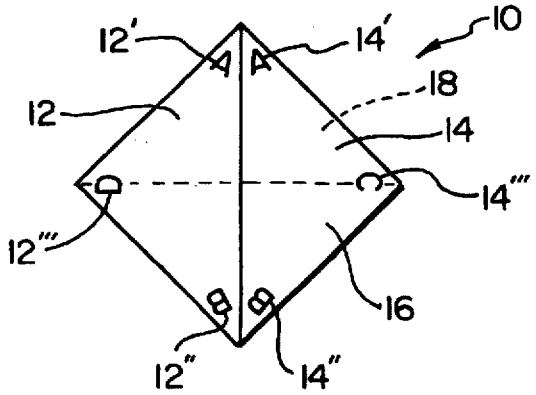
FIG. 1 PRIOR ART
FIG. 1 is a perspective view of a prior art four-faced die having a tetrahedron shape.
Figure 2:
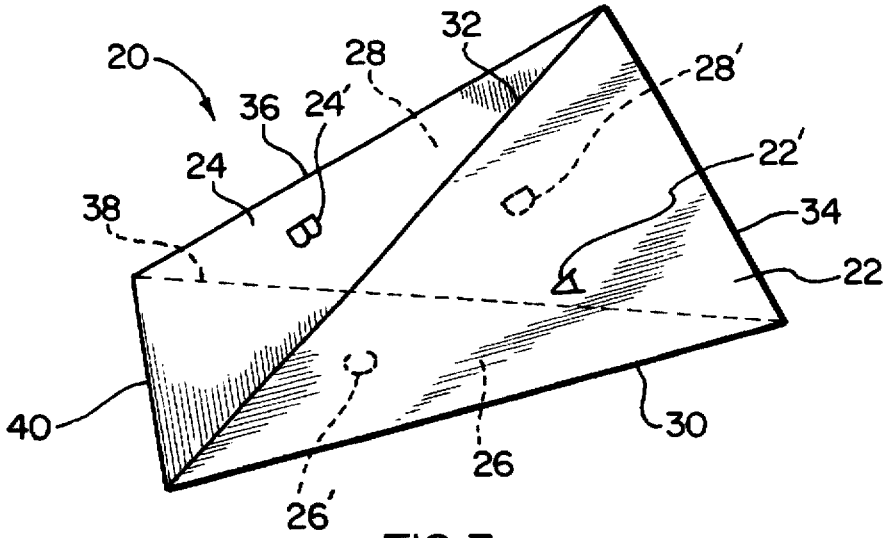
FIG. 2 is a perspective view of a four-faced die in accordance with the present invention.

Referring first to FIG. 2, there is shown a die 20 having faces 22, 24, 26 and 28. Faces 22, 26 and 28 have indicia 22', 24', 26' and 28', respectively. The indicia shown in FIG. 2 are letters. The indicia also could be, e.g., numbers, pictures, colors or a combination thereof. Although in FIG. 2 indicia 22', 24', 26' and 28' are different from one another, in some applications it may be desirable to have identical indicia on two or three of the faces. In the preferred embodiment, when faces 22, 24, 26 and 28 have different indicia, the probability distribution is uniform—i.e., each of indicia 22', 24', 26' and 28' has a 25% chance of being the outcome from the roll of die 20 because each of faces 22, 24, 26 and 28 has a 25% chance of being the selected face. Die 20 alternatively could have a nonuniform probability distribution. An example of a nonuniform probability distribution would be a die in accordance with the present invention having three red faces and one blue face. Such a die would have a 75% chance of red being the outcome from the roll and a 25% chance of blue being the outcome from the roll. Other probability distributions are possible as well.

Figure 3:
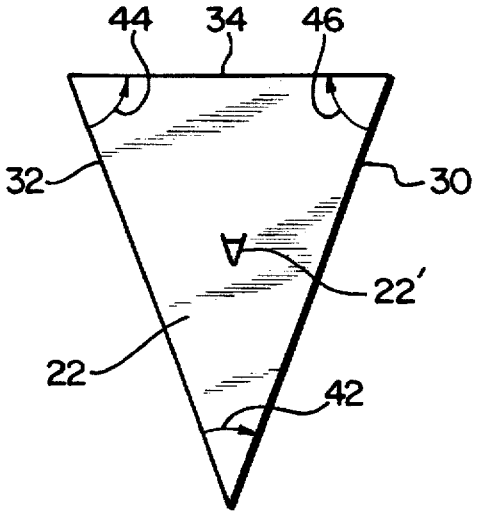
FIG. 3 is a top plan view of one face of a four-faced die in accordance with the present invention.

FIG. 3 is a top plan view of face 22. Face 22 is representative of the other faces of die 20. Face 22 is in the shape of an isosceles triangle. Face 22 is defined by a first edge 30, a second edge 32 and a third edge 34. First edge 30 and second edge 32 have an equal length. Third edge 34 has a different, and preferably shorter, length than first edge 30 and second edge 32. Edges 30, 32 and 34 also define angles 42, 44 and 46. The edges of die 20 can be straight, beveled or rounded, as is known in the art.

As shown in FIG. 2, die 20 also includes additional edges 36, 38 and 40. Edges 36 and 38 have the same length as edges 30 and 32. Edge 40 has the same length as edge 34.

Each of edges 30, 32, 36 and 38 forms one of the equal length edges for two adjacent faces of die 20. For example, edge 30 forms one of the equal length edges of faces 22 and 26. Each of edges 34 and 40 forms a third edge for two adjacent faces of die 20. For example, edge 34 forms a third edge for faces 22 and 28. The surface area defined by the isosceles triangle of face 22 is preferably the same as the surface areas defined by the isosceles triangles of faces 24, 26 and 28.

The length of either of the equal length edges and the third edge of each face form a ratio of about 5:3. For example, the equal length edges can be about 1.25 inches and the third edge can be about 0.75 inches. Angle 42 can be about 35°. Thus, angles 44 and 46 can be about 72.5°. Angle 42 can be anywhere in the range from 0° to 90°, exclusive of the end points of the range. Therefore, another example for the angles is angle 42 being 45° and angles 44 and 46 being 67.5°.

Die 20 can be made of any rigid substrate including plastic, metal or wood. Die 20 preferably is made of a plastic such as an acrylic-modified or urea-modified plastic. Die 20 can be made by injection molding or compression molding. These processes are known in the art.

Die 20 can be rolled on a flat surface to determine a selected face having an indicium that serves as the outcome of the roll. When die 20 is rolled, one of its faces will come to rest on the surface. Unlike most prior art four-faced dice, that face is not the selected face. The selected face is the face that extends upwardly from the surface and has its third edge parallel to the flat surface. For example, if die 20 in FIG. 2 were resting on a flat surface, face 24 would be the selected face. Face 24 extends upwardly and has its third edge 40 parallel to the flat surface. Only one of said faces extends upwardly from the surface and has its third edge parallel to the surface.

Thus, it can be seen that die 20 uses an efficient amount of material and can have its selected face read without resorting to picking up the die. In addition, because only one indicium (rather than three) is placed on each face, the indicia can be larger and more elaborate, e.g., pictures, etc. Finally, die 20 provides an equal chance for each of the four faces to be selected. Thus, the present invention solves many problems that existed with the prior art four-faced dice.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. A four-faced die that is rolled on a flat surface to determine a selected face, comprising:

only four faces, each said face having edges that form an isosceles triangle, each said face having a first edge and a second edge of equal length and a third edge having a different length;

wherein each said equal length edge of each said face forms one of the equal length edges of an adjacent said face;

wherein each said third edge of each said face forms said third edge of an adjacent said face;

wherein each said face includes an indicium thereon; and wherein when one of said faces is at rest on the flat surface, another one of said faces extends upwardly from the surface and has its third edge parallel to the flat surface, said face forming the selected face.

2. The die of claim 1 wherein the length of said first edge is greater than the length of said third edge.

3. The die of claim 2 wherein the length of said first edge and the length of said third edge of one of said faces form a ratio of about 5:3.

4. The die of claim 1 wherein the angles defined by said edges of each said face are about 72.5°, 72.5° and 35°.

5. The die of claim 1 wherein said die is made of plastic.

6. The die of claim 1 wherein the surface areas defined by the isosceles triangles of each said face are equal.

7. The die of claim 1 wherein each of said faces has an equal chance of being the selected face.

8. The die of claim 1 wherein the probability distribution of said die is uniform.

9. The die of claim 1 wherein the probability distribution of said die is nonuniform.

10. The die of claim 1, wherein said face at rest on the flat surface is adjacent said selected face.

11. A four-faced die, comprising:

only four triangular faces, each said face having a first edge and a second edge of equal length and a third edge having a different length; and an indicium located on each said face;

wherein when said die is at rest on a flat surface, exactly one of said four faces extends upwardly from the surface and has its third edge parallel to the flat surface.

12. The die of claim 11, wherein said upwardly extending face is adjacent another of said faces which is at rest on the flat surface.

* * * * *